United States Patent [19]

Ashworth

[11] 4,286,721

[45] Sep. 1, 1981

[54] ACCESS EQUIPMENT

[75] Inventor: Denis H. Ashworth, Dudley, England

[73] Assignee: Simon Engineering Dudly Limited, West Midlands, England

[21] Appl. No.: 93,438

[22] Filed: Nov. 13, 1979

Related U.S. Application Data

[63] Continuation of Ser. No. 826,121, Aug. 19, 1977, abandoned, which is a continuation of Ser. No. 623,632, Oct. 20, 1975, abandoned.

[51] Int. Cl.[3] ..... E04G 1/36; B66C 23/06

[52] U.S. Cl. ..... 212/199; 182/2; 212/231; 212/160; 414/700

[58] Field of Search ..... 108/137; 187/8.71; 182/2, 128, 150; 212/192, 199, 229, 160, 231; 414/700, 682

[56] References Cited

U.S. PATENT DOCUMENTS

| | | | |
|---|---|---|---|
| 349,066 | 9/1886 | Stahl | 212/199 |
| 584,187 | 6/1897 | McCabe et al. | 212/256 |
| 1,864,934 | 6/1932 | Reeves | 182/145 |
| 3,306,396 | 2/1967 | Goss | 182/2 |
| 3,407,947 | 10/1968 | Valla | 212/264 |
| 3,556,252 | 1/1971 | Atkins | 212/199 |
| 3,602,335 | 8/1971 | Gustetic | 182/142 |
| 3,788,414 | 1/1974 | Netter | 187/8.71 |

FOREIGN PATENT DOCUMENTS

| | | | |
|---|---|---|---|
| 2003649 | 8/1971 | Fed. Rep. of Germany . | |
| 1436649 | 12/1966 | France . | |
| 1571525 | 6/1969 | France | 182/128 |

*Primary Examiner*—Lawrence J. Oresky
*Attorney, Agent, or Firm*—Norris & Bateman

[57] ABSTRACT

Apparatus enabling access to the interior surfaces bounding a large spaced comprises a pole adapted to extend vertically through the height of the space with its lower end located at the base of the space, at least one boom structure connected with said pole, a working platform connected to the end of said boom structure remote from said pole and the height of said boom structure is adjustable relative to said pole.

11 Claims, 8 Drawing Figures

ACCESS EQUIPMENT

This is a continuation of application Ser. No. 826,121 filed Aug. 19, 1977, now abandoned, which in turn is a continuation of Ser. No. 623,632, filed Oct. 20, 1975 now abandoned.

This invention concerns apparatus enabling an operator or operators to have access to the interior surfaces bounding large spaces, particularly though by no means exclusively, the cargo storage spaces of ships and especially the sections of the cargo tanks of very large crude carriers, for inspection, cleaning, shot-blasting, painting and general repair purposes.

Very large crude carriers are constructed in the form of a series of rectangular sections, each such section forming a tank or part of a tank. Typical dimensions for such a section in a half-million ton tanker are as follows:
Length (longitudinally of the ship)—5 meters
Depth—36 meters
Width (transversely of the ship)—21 meters The walls between adjacent sections may be flat and plane or plane with vertical or horizontal ribs at various spacings and may sometimes be provided with large interconnecting holes.

Access to the interior surfaces of these sections (that is the vertical walls and underside of the deck or deck head) present a particularly difficult problem in that the hull of the ship is designed as a continuous closed box, so that the only access to the sections is through small holes varying from circular holes of 0.3 meters diameter to oval holes of 1.5 meters by 1.0 meters in the deck. In general, there is no more than one such hole per section, usually located on the longitudinal centre line of the section, but positioned anywhere along the length of the centre line. In some cases there is no access hole in the deck and access to a particular section must be through a hole in a vertical wall between the section and an adjacent section.

The apparatus of the invention is intended for use separately with each section, and an access hole in the deck of each section is assumed. Obviously, where this is not the case holes must be cut in the deck to give access to each section, and such holes must be provided with suitable covers then forming part of the permanent structure of the ship.

According to the present invention, apparatus enabling access to the interior surfaces bounding a large space comprises a pole adapted to extend vertically through the height of the space with its lower end located at the base of the space, at least one boom connected with said pole, a working platform connected to the end of said boom remote from said pole and means for adjusting the height of said boom relative to said pole.

According to a preferred feature of the invention, said boom can be adjusted so as to move said working platform towards or away from said pole.

Preferably, said boom is pivotally connected to a carriage which is vertically slidable along said pole and means is provided for adjusting the angle of inclination of said boom relative to said pole and the height of said carriage on said pole.

As we have seen, the depth of the cargo sections can be quite substantial and the pole must thus be of considerable length. For it to be rigid its cross-sectional area must be substantial. Increase in cross-sectional area, however, tends to be self-defeating in that the weight of the pole and hence degrees of compression therein is increased, thus facilitating flexing of the pole.

Thus, according to a further preferred feature of the invention, means is provided to ensure that the pole is in a state of tension when the apparatus is in use.

Preferably, means is located on the base of the section which restrain the lower end of the pole from lateral movement whilst not supporting same against downward movement, the pole being secured at its upper end, all whereby the pole is in a state of tension by virtue of its own weight.

The invention will be further apparent from the following description with reference to the several figures of the accompanying drawings which show, by way of example only, two forms of apparatus embodying the invention.

Figure 1:
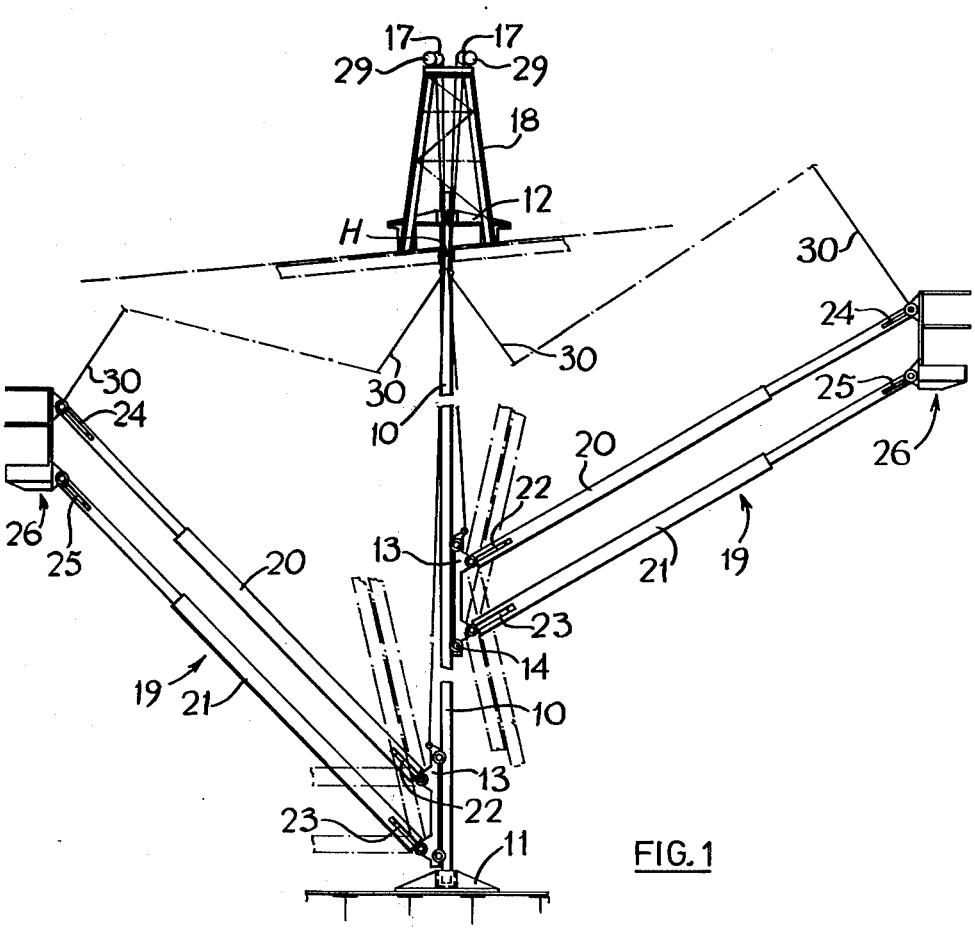
FIG. 1 is a side elevation of one form of the apparatus.

Referring now to the drawings, it will be seen that the apparatus embodying the invention essentially comprises a pole 10 whose construction will be described in greater detail hereinafter. The pole 10 extends vertically through a section of cargo tank, and has its lower end located in a special fitting 11 which is positioned on the base of the section. The fitting 11 may be secured by means of clamps or the like, but may be provided as a part of the permanent structure of the ship, being welded or otherwise secured in position.

The pole 10 is assembled in the section in a manner to be described hereinafter, but has its upper end held by a special fitting 12 positioned on the topside of the deck over a hole H in the deck giving access to the section and through which components of the pole are passed to permit its assembly within the section.

The fitting 11 restrains the lower end of the pole from lateral displacement and rotational movement but does not support same against downward movement. In this way the pole 10 is maintained in a state of tension by virtue of its own weight, thus increasing its rigidity and reducing its tendency to flex when subjected to lateral loads.

Two carriages 13 are provided and located one on each of opposite sides of the pole 10. Each carriage 13 carries a plurality of flanged rollers 14 which engage with corners of the pole 10 and thus prevent movement of the carriage away from the pole in two directions. Each carriage 13 is restrained from movement away from the pole 10 in the remaining direction by a shoe member 15 which is partially located within the confines of the pole 10 and as clearly shown in FIG. 6. Each carriage 13 is able to be moved up and down along the length of the pole 10 by means of a cable 16 secured to same and passing out through the hole H in the deck to a suitable winch 17 mounted on a derrick 18 which has been erected above the hole H. It will be understood that two winches 17 are provided, one for each carriage 13.

A boom generally indicated at 19 extends outwardly from each carriage 13. Each boom comprises upper and lower arms 20 and 21 whose inner ends are anchored to plates 22 and 23 respectively. The plates 22 and 23 are pivotally connected to the carriage 13 at vertically spaced axes each parallel with the longitudinal axis of the ship. Likewise, the outer ends of the arms 20 and 21 are anchored to plates 24 and 25. The outer end of each boom 19 carries a working platform or cage generally indicated at 26, and which essentially includes a section 27. The plates 24 and 25 are pivotally connected to the section 27 at vertically spaced axes, each parallel with the longitudinal axis of the ship. It will be understood that the arms 20 and 21 together with the carriage 13 and section 27 form a parallelogram linkage such that the working platform or cage 26 will always maintain a horizontal position in space regardless of the angle of inclination of the boom 19. The boom is arranged to hinge through a vertical arc of approximately 150° whereby the cage 26 can be moved between positions closely adjacent the pole 10, either above or below the location of the carriage 13. Each of the arms 20 and 21 is telescopically extendible and can be locked at a required length by manual means 28 best seen in FIG. 2. Equally the inner and outer ends of each of the arms 20 and 21 may be anchored to their associated plates at adjustable angles to enable the cage 26 to be located centrally longitudinally of the section regardless of the position of the pole 10 and hence hole H longitudinally of the section.

Figure 2:
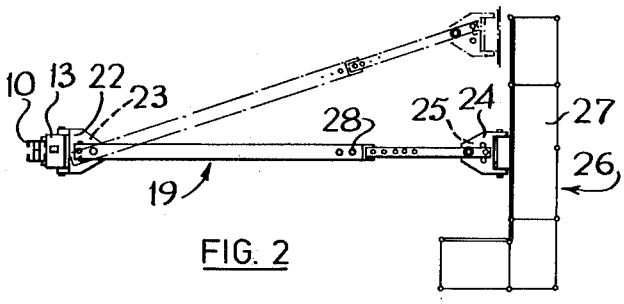
FIG. 2 is a plan view of one of the booms of the apparatus of FIG. 1 together with its associated working platform or cage.

As best seen from FIG. 2, the working platform or cage 26 is provided with three further sections which are detachable from the central section 27. In this way, the shape and size of the cage 26 may be varied readily to accommodate varying lengths of tank section and to clear any corners in a tank section.

On the derrick are a total of four winches. Two 17 are provided to enable the carriages 13 to be raised and lowered as previously described, and a further two indicated at 29 are provided to adjust the elevation of each of the cages 26 relative to its associated carriage 13 by means of wires 30 extending from the winches 29 to the outer ends of the booms 19.

In use, the carriages, boom parts and cages are taken into the tank section to which access is required and assembled ready for connecting to the pole 10 when the latter is erected and in position. It follows that the carriages, booms and cages must all be capable of being stripped down to components which can be passed through such holes as are available to give access to the section.

Figure 3:
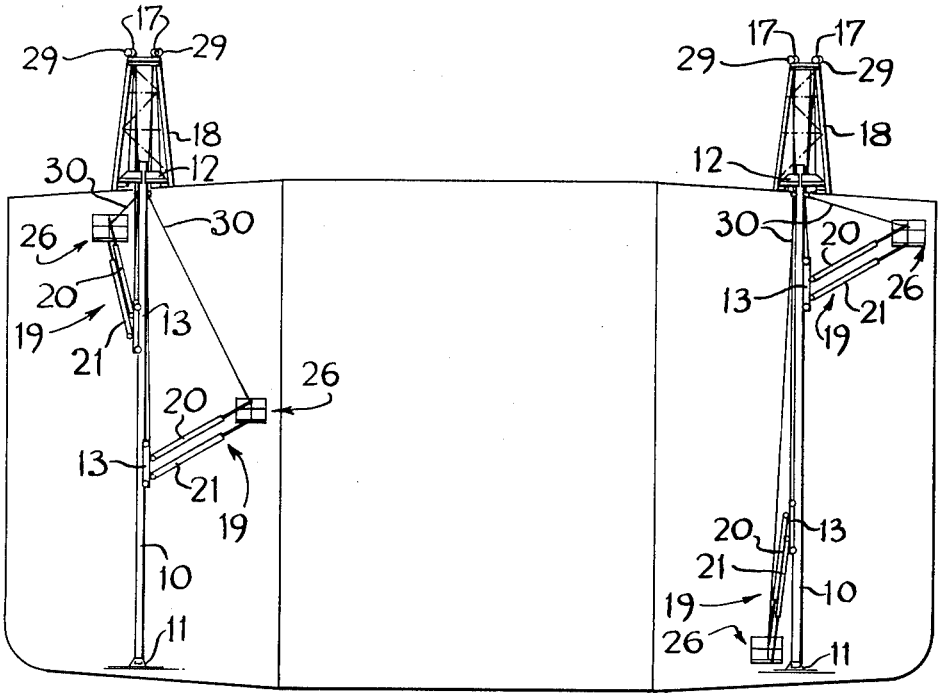
FIG. 3 is a transverse cross-section through a very large crude carrier showing sets of apparatus embodying the invention in use in sections of the cargo tanks thereof.
Figure 4:
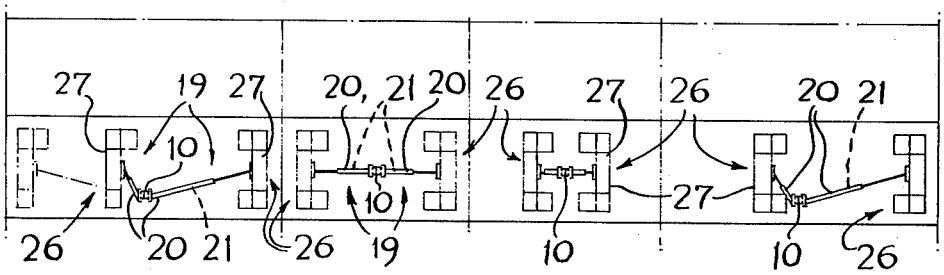
FIG. 4 is a fragmentary plan view of a very large crude carrier with the deck cut away to show four sets of apparatus embodying the invention, positioned in four sections of the cargo tanks thereof.

When the apparatus is fully assembled access may be had to all positions on the walls and roof of the tank section, the two cages servicing opposite halves of the section, as clearly seen from FIGS. 3 and 4. Preferably arrangements are provided whereby the movements of the carriages and booms can be controlled from the cages, a pendant type electrical push-button control being particularly suitable for this purpose.

Figure 5:
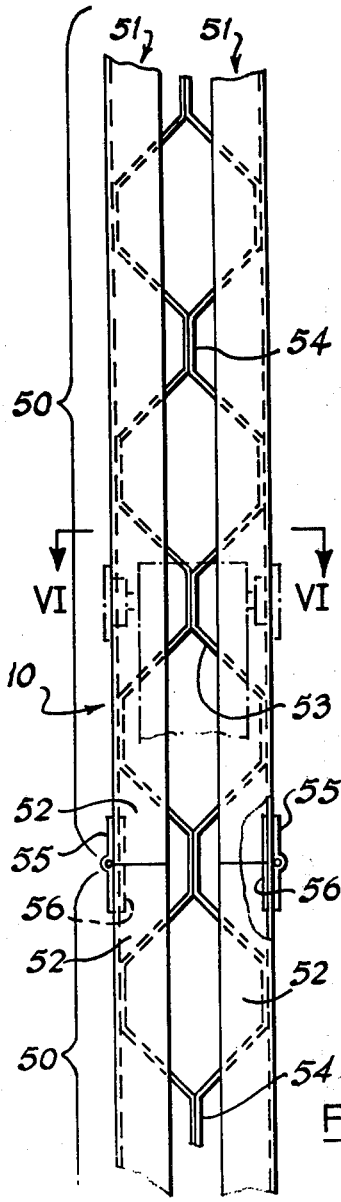
FIG. 5 is a side elevation of the pole of the apparatus of FIG. 1 on an enlarged scale.
Figure 6:
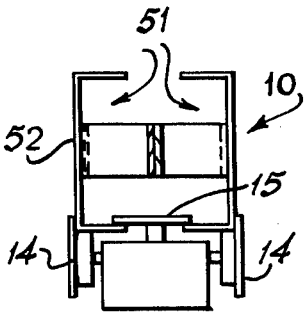
FIG. 6 is a cross-section through the pole on the line VI—VI of FIG. 5 with a carriage located therein.
Figure 7:
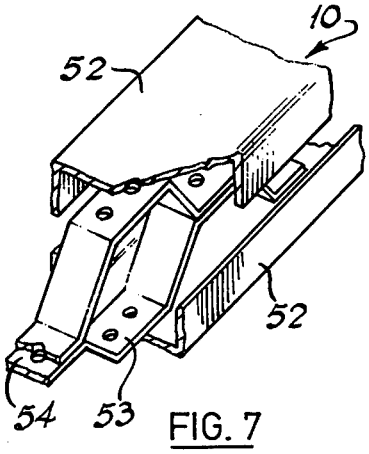
FIG. 7 is a cut-away perspective view of part of the pole of the apparatus of FIG. 1.

Turning now to FIGS. 5 to 7 inclusive, it will be seen that the pole 10 is conveniently comprised by a plurality of sections 50 arranged vertically one above the other. Each section 50 is comprised by two opposed halves 51. Each such half 51 consists of a channel member 52 and a lacing strip 53 secured on the inside thereof. Each lacing strip defines a plurality of land portions 54 located outwardly of the edge of the flanges of the channel member 52. The two halves 51 of each section 50 are jointed by bolting together the oppositely disposed of these land portions 54.

The vertically adjacent channel members 52 of adjacent sections 50 are joined together by hinge members 55 and fish-plates 56.

If the pole 10 has an overall cross-sectional area greater than the cross-sectional area of the hole H in the deck, the halves 51 of each section 50 of the pole 10 must be lowered separately through the hole, using the winches on the derrick as a crane, and bolted together to form the pole from the inside of the cargo section. By virtue of the hinges 55 each half 51 can be secured to the half immediately therebeneath before being lowered through the hole H.

Figure 8:
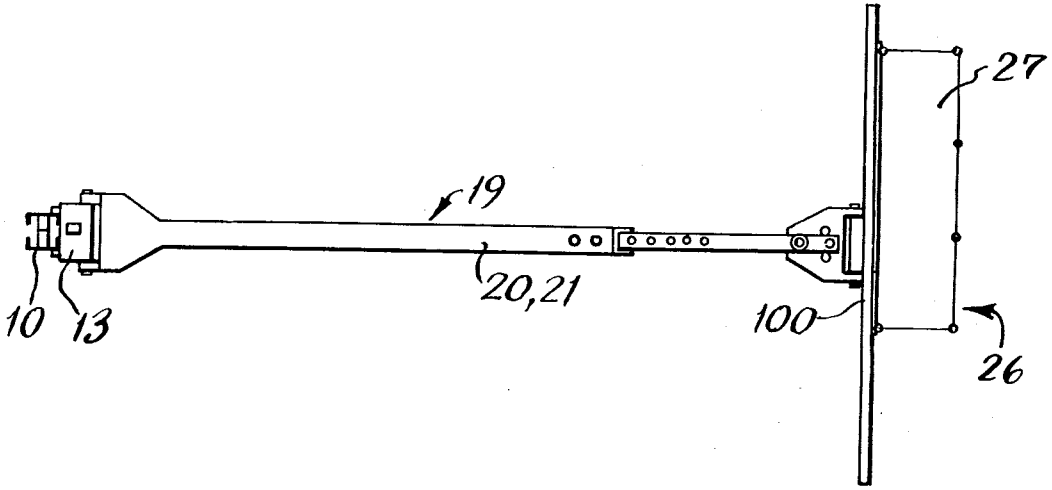
FIG. 8 is a plan view similar to that of FIG. 2 but of a second form of apparatus having a modified construction.

Referring now to FIG. 8, it will be seen that in this embodiment of the invention the arms 20 and 21 cannot be pivoted about a vertical axis relative to the carriage 13 or cage 26. In this arrangement the arms 20 and 21 support a transversely extending beam 100 on which the cage may be mounted at different lateral positions, as an alternative means of adjusting the position of the cage laterally in a direction transverse to the direction in which the arms 20 and 21 extend.

Normally the arms 20 and 21 will be provided with shock-absorbing means and the carriage 13 with automatically operable brake means as a precaution against breakage of a cable 30 or cable 16 respectively.

It will be appreciated that it is not intended to limit the invention to the above example only, many variations, such as might readily occur to one skilled in the art, being possible without departing from the scope thereof, as defined by the appended claims.

Thus, for example, the angle of inclination of the boom relative to the pole may be adjusted by means of an hydraulic cylinder extending between the carriage and linkage on the boom or by other actuating means.

It is an essential feature of the invention that the working platform or cage can be moved towards and away from the pole. This is conveniently achieved by means of a pivoting boom as described hereinbefore. As an alternative the boom which connects the working platform or cage with the pole may be of telescopic construction or again constructed in the fashion of "lazy tongs."

Again, for example, the working platform or cage need not be comprised by a plurality of sections and may be comprised by a single section only.

Yet again, for example, the halves 51 of the sections 50 of the pole 10 may be joined together by fish-plates alone rather than hinges 55 as well as fish-plates.

Still again, for example, the pole need not be formed from two laterally adjacent halves but may have a cross-section comprised by one piece. Such a simplified pole would be particularly suitable where its height does not need to be too great.

What is claimed is:

1. Apparatus enabling access to the interior surfaces bounding a large space such as a ship cargo tank comprising a rigid pole suspended at its upper end with its lower end unsupported vertically adapted to extend vertically through the height of the space with its lower end located at the base of the space, a wheeled carriage mounted for vertical movement along said pole, at least one boom structure pivotally connected at one end with said carriage, a working platform connected to the end of said boom structure remote from said pole, powered means adapted to be located above and outside the tank operably connected to said wheeled carriage for adjusting the height of said boom structure within said space, means operable by an operator on said working platform for adjusting the boom structure for moving the working platform vertically and toward or away from said pole, and means whereby said lower end of the pole is located in a fitting adapted to be mounted in the tank to operatively receive the base of the pole so as to restrain the pole against lateral or rotational movements.

2. The apparatus defined in claim 1, wherein said boom structure is so pivotally mounted on a horizontal axis on said wheeled carriage as to be capable of swingable displacement through a vertical arc of about 150°.

3. Apparatus enabling access through a reduced size top opening to the interior surfaces of a structure bounding a large space for cleaning, repair and like operations at said surfaces comprising a vertically rigid non-rotatable pole suspended from its upper end to extend vertically through the height of the space with its upper end at said opening and with its lower end vertically unsupported and located at the base of the space, at least one wheeled carriage mounted for vertical movement along said pole, at least one telescopically extensible and retractable boom structure pivotally mounted at one end of said carriage for pivoting in both horizontal and vertical directions relative to said carriage, a working platform mounted on the end of said boom structure remote from said pole, means operative through said opening for adjusting the height of said carriage on said pole for varying the height of said boom structure relative to said pole while an operation is taking place at said surfaces, and means operable by an operator on the platform for adjusting the boom structure for moving the working platform toward or away from said pole.

4. Apparatus according to claim 3, wherein each said boom structure is comprised by a pair of parallel spaced arms lying in a common vetical plane which together with the working platform and the carriage form a parallelogram linkage such that the working platform remains parallel to the pole and thus horizontal regardless of the angle of inclination of the arms.

5. Apparatus as defined in claim 4, wherein there are separate wheeled carriages and associated boom structure mounted on opposite sides of said pole.

6. In the apparatus defined in claim 3, said pole having a channel shape in cross section and said wheeled carriage having pole mounting rollers that so interfit with said channel cross section as to restrain the carriage against lateral displacement of the pole.

7. In the apparatus defined in claim 3, said pole and carriage having an interfitting slide guide connection that restrains the carriage against displacement away from the pole.

8. Apparatus enabling access through a relatively small opening to interior surfaces bounding a large space, comprising a pole suspended from its upper end and adapted to extend vertically through the height of the space with its lower end located at the base of the space and with its lower end unsupported vertically, a wheeled carriage mounted to be movable up and down the pole, at least one extensible boom structure pivotally connected at one end to said carriage, a working platform pivotally connected to the end of said boom structure remote from said pole, powered driving means for adjusting the height of said carriage along said pole to dispose the boom structure at different levels and for pivoting the boom structure relative to the carriage, thus to move the working platform towards or away from the pole at substantially any level of the carriage, said powered means being located at the top of the pole at said opening and outside of said space, fitting means at the base of the pole whereby said lower end of the pole is restrained from lateral movement in said space, and control means for said powered means accessible to a workman on said platform whereby said powered driving means may be operated when an operator is located on the working platform to effect movements of the carriage and the boom structure for enabling the operator to gain access to the said interior surfaces.

9. Apparatus enabling access to the interior surfaces bounding a large space comprising a non-rotatable pole rigid from end to end adapted to extend vertically through the height of the space with its lower end located at the base of the space, a carriage mounted for slidable vertical movement along said pole, at least one boom structure pivotally connected at one end with said carriage, a working platform pivotally connected to the end of said boom structure remote from said pole, means for adjusting the height of said boom structure relative to said pole, means for adjusting each said boom structure so as to move the working platform connected thereto towards or away from said pole, and means for adjusting the angle of said boom structure about a vertical axis relative to both said carriage and said working platform.

10. Apparatus according to claim 9, wherein each said boom structure is comprised by a pair of parallel spaced arms lying in a common vertical plane which together with the working platform and the carriage form a parallelogram linkage such that the working platform remains horizontal regardless of the angle of inclination of the arms.

11. Apparatus enabling access through a relatively small opening to interior surfaces bounding a large space, comprising a pole adapted to extend vertically through the height of the space with its lower end located at the base of the space, a wheeled carriage mounted to be movable up and down the pole, at least one boom structure pivotally connected at one end to said carriage, a working platform pivotally connected at one end to said carriage, a working platform pivotally connected to the end of said boom structure remote from said pole, powered driving means for adjusting the height of said carriage along said pole to dispose the boom structure at different levels and for pivoting the boom structure relative to the carriage, thus to move the working platform towards or away from the pole at substantially any level of the carriage, said powered means being located at the top of the pole at said opening and outside of said space, means for mounting said pole whereby the pole is non-rotatable about its longitudinal axis and the lower end of the pole is unsupported vertically, fitting means at the base of the pole whereby said lower end of the pole is restrained from lateral movement in said space, means for adjusting the angle of said boom structure about a vertical axis relative to both said carriage and said working platform, and control means for said powered means accessible to a workman on said platform whereby said powered driving means may be operated when an operator is located on the working platform to effect movements of the carriage and the boom structure for enabling the operator to gain access to the said interior surfaces.

* * * * *